US009106029B2

(12) United States Patent
Ho

(10) Patent No.: US 9,106,029 B2
(45) Date of Patent: Aug. 11, 2015

(54) ELECTRICAL CONNECTION DEVICE

(71) Applicant: Molex Incorporated, Lisle, IL (US)

(72) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 125 days.

(21) Appl. No.: 14/049,802

(22) Filed: Oct. 9, 2013

(65) Prior Publication Data

US 2014/0213076 A1 Jul. 31, 2014

(30) Foreign Application Priority Data

Oct. 11, 2012 (TW) ..... 101219631

(51) Int. Cl.

| | |
|---|---|
| ***H01R 12/00*** | (2006.01) |
| ***H01R 12/72*** | (2011.01) |
| ***H01R 12/73*** | (2011.01) |
| ***H01R 13/24*** | (2006.01) |

(52) U.S. Cl.

CPC ..... *H01R 12/724* (2013.01); *H01R 12/732* (2013.01); *H01R 13/2442* (2013.01)

(58) Field of Classification Search

CPC ..... H01R 9/096
USPC ..... 439/65, 862, 342, 376
See application file for complete search history.

(56) References Cited

U.S. PATENT DOCUMENTS

| | | | | |
|---|---|---|---|---|
| 4,657,320 | A * | 4/1987 | Bamford et al. | 439/31 |
| 6,875,049 | B2 * | 4/2005 | Kyowski et al. | 439/500 |
| 7,048,547 | B2 | 5/2006 | Gottwald | |
| 7,704,089 | B2 | 4/2010 | Tseng | |
| 7,959,445 | B1 * | 6/2011 | Daily et al. | 439/65 |
| 8,206,159 | B2 * | 6/2012 | Naito et al. | 439/65 |
| 2010/0304582 | A1 | 12/2010 | Vittapalli et al. | |
| 2013/0122752 | A1 | 5/2013 | Lu | |

FOREIGN PATENT DOCUMENTS

| | | |
|---|---|---|
| TW | I361024 B | 3/2012 |

* cited by examiner

*Primary Examiner* — Phuong Dinh
(74) *Attorney, Agent, or Firm* — Stephen L. Sheldon

(57) ABSTRACT

An electrical connection device is used to be provided in an electronic device casing, and comprises a first circuit board and a second circuit board which are substantially coplanar, a receptacle connector provided to the first circuit board and a plug connector provided to the second circuit board. The receptacle connector comprises a housing and a plurality of first terminals. The housing has a first mating surface, and a pair of sliding contact grooves respectively adjacent to both sides of the first mating surface. The plug connector comprises a body and a plurality of second terminals. The body has a pair of side flanges respectively engaged with and received in the sliding contact grooves. The plug connector is mated with the receptacle connector in a direction perpendicular to a board surface of the first circuit board.

7 Claims, 12 Drawing Sheets

ELECTRICAL CONNECTION DEVICE

RELATED APPLICATIONS

This application claims priority to Taiwanese Application No. 101219631, filed Oct. 11, 2012, which is incorporated herein by reference in its entirety.

TECHNICAL FIELD

The present disclosure relates to an electrical connection device, particularly to an electrical connection device electrically connected to two circuit boards which are substantially coplanar.

BACKGROUND ART

An I/O connector, such as a USB receptacle and the like, is provided in a side face of a casing of most of laptop computers in the prior art, so as to facilitate user operation. And the laptop computers have various sizes to meet different use requirements. As the I/O connector is generally provided on a circuit board and partially protrudes from an edge of the circuit board to be received in a corresponding opening of the side face of the casing, the edge of the circuit board is required to be close to the side face of the casing as much as possible. In other words, a size of the circuit board is required to match with a size of the casing, so as to allow the periphery edge of the circuit board close to the side face of the casing. Therefore, the laptop computer having different sizes respectively requires circuit board having corresponding sizes, and the circuit boards having the same size can not be used. That is, when the laptop computers having different sizes are developed, the circuit boards having the corresponding sizes are additionally required and developed, thereby resulting in long development time and high cost.

In order to solve the above problem, Taiwanese patent No.TWI361024B1 provides a motherboard which can be mounted on laptop computers having different sizes. The motherboard comprises a first portion, a second portion and a connecting device movably connected to the first portion and the second portion, the connecting device can adjust a relative distance between the first portion and the second portion, so as to adjust an overall size of the motherboard. The first portion and the second portion are respectively provided with connectors, and a cable which has connectors at both ends respectively is used for connecting the connectors positioned in the first portion and the second portion, so as to electrically connect the first portion and the second portion.

However, a total of one cable and the four connectors are additionally required for connecting the first portion and the second portion, causing high manufacturing cost. In addition, signal transmission between the first portion and the second portion must flow through two pairs of connectors and one cable and increasing the number of connection tends to increase insertion loss and tends to cause poor electrical characteristics.

SUMMARY OF THE INVENTION

Therefore, an electrical connection device of the present disclosure is used to be provided in an electronic device casing, the electrical connection device comprises a first circuit board having a first side edge, a second circuit board, a receptacle connector and a plug connector. The second circuit board is substantially coplanar with the first circuit board and has a second side edge opposite to the first side edge. The receptacle connector is provided to the first circuit board and is closely adjacent to the first side edge, and comprises an housing and a plurality of first terminals. The housing has a first mounting surface abutting against a board surface of the first circuit board, a first mating surface, and a pair of sliding contact grooves respectively adjacent to both sides of the first mating surface. And the first mating surface and the sliding contact grooves are substantially perpendicular to a plane where the first mounting surface is present. The first terminals each having a first fixed portion fixedly provided to the housing, a first contact portion exposed from the first mating surface, and a first tail portion exposed from the first mounting surface and electrically connected to the first circuit board. The plug connector is provided to the second circuit board and partially protrudes from the second side edge, and comprises an body and a plurality of second terminals. The body has a second mounting surface abutting against a board surface of the second circuit board, a second mating surface substantially perpendicular to a plane where the second mounting surface is present and corresponding to the first mating surface, and a pair of side flanges respectively adjacent to both sides of the second mating surface and respectively engaged with and received in the sliding contact grooves. The second terminals each have a second fixed portion fixedly provided to the body, a second contact portion exposed from the second mating surface, and a second tail portion exposed from the second mounting surface and electrically connected to the second circuit board. The second contact portions of the second terminals respectively contact the first contact portions of the first terminals so as to form an electrical connection.

In an embodiment, one of the first circuit board and the second circuit board is provided with a plurality of I/O connectors with insert ports thereof exposed from a side surface of the electronic device casing.

In an embodiment, the other one of the first circuit board and the second circuit board is provided with a central processor.

In an embodiment, the second terminals each further have an extension portion connected to the second fixed portion and the second contact portion, the extension portion extends substantially parallel to the plane where the second mounting surface is present and has a plurality of protrusions respectively protruding from both sides close to the second contact portion, the second fixed portion and the second contact portion are substantially perpendicular to the extension portion.

In an embodiment, the first contact portions of the first terminals have resilience, the second contact portions of the second terminals are in form of flat plate shape.

In an embodiment, the side flanges each have a bottom surface coplanar with the second mounting surface.

In an embodiment, the first circuit board further has a notch recessing inwardly from the first side edge. The housing further has a bottom projection positioned at bottom sides of the first mating surface and the sliding contact grooves, the bottom projection is received in the notch and together defines a receiving groove. The body further has a bottom flange connected to bottom sides of the second mating surface and the side flanges and protruding from the bottom surfaces of the side flanges, and the bottom flange is engaged with and received in the receiving groove.

The effects of the present disclosure are as follows.

DETAILED DESCRIPTION OF THE PREFERRED EMBODIMENTS

Figure 1:
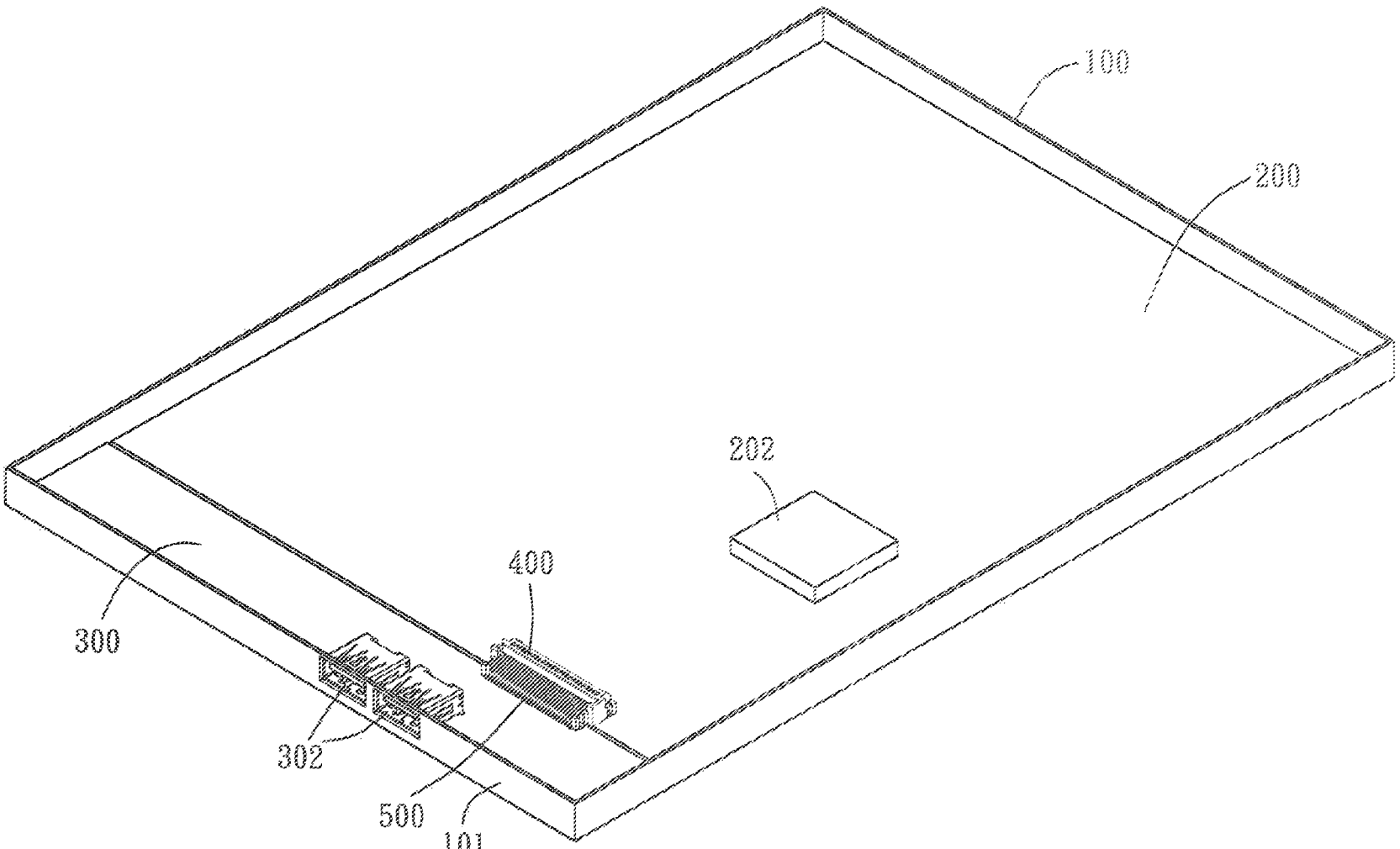
FIG. 1 is a perspective view illustrating that an electrical connection device of an embodiment of the present disclosure is provided in an electronic device casing.
Figure 2:
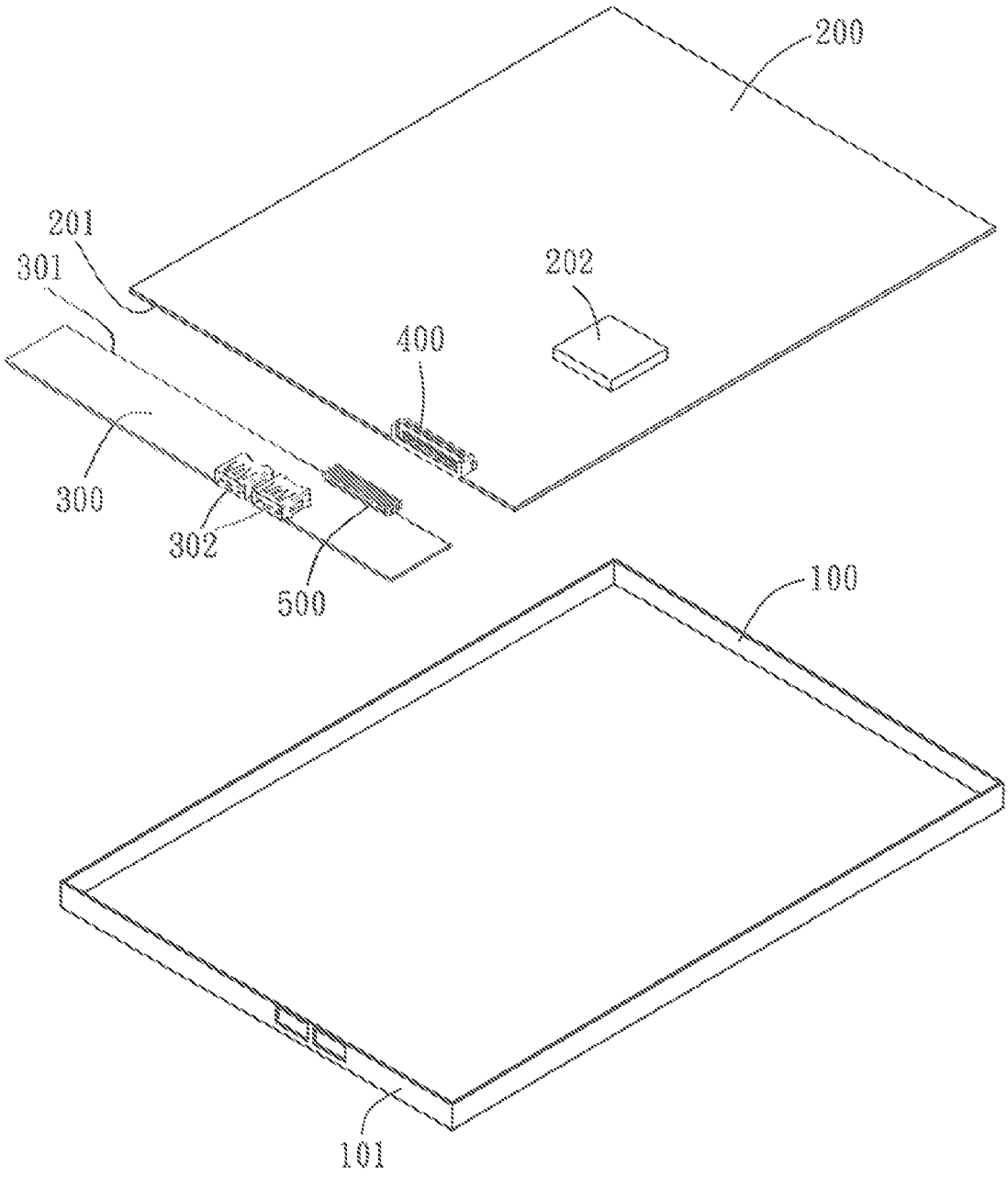
FIG. 2 is a perspective view illustrating that a receptacle connector and a plug connector of the embodiment are respectively provided to a first circuit board and a second circuit board in a non-mating state.

The foregoing and other technical contents, features and effects of the present disclosure will be apparent through the following detailed description for a specific embodiment in combination with the drawings. As can be appreciated, a benefit of the present disclosure is to provide an electrical connection device for electrically connecting a first circuit board and a second circuit board. In addition, in the electrical connection device, the receptacle connector and the plug connector are electrically connected to the first circuit board and the second circuit board, both of which are substantially coplanar. However, the second circuit board can have different sizes, which can allow the I/O connector on the second circuit board to be exposed from the side surface of the electronic device casing in the electronic device casing having a different size, which can help adapt the I/O connector to electronic devices having different sizes. Furthermore, as the receptacle connector is directly electrically connected to the plug connector, this allows for a reduction in the impedance so as to provide good electrical characteristics and also helps reduce costs.

Referring to FIGS. 1-4, an electrical connection device of an embodiment of the present disclosure is used to be provided in an electronic device casing 100, and comprises a first circuit board 200, a second circuit board 300, a receptacle connector 400 and a plug connector 500. The first circuit board 200 is substantially coplanar with the second circuit board 300, and the first circuit board 200 has a first side edge 201 adjacent to the second circuit board 300, the second circuit board 300 has a second side edge 301 opposite to the first side edge 201. The receptacle connector 400 is provided to the first circuit board 200 and is closely adjacent to the first side edge 201. The plug connector 500 is provided to the second circuit board 300 and partially protrudes from the second side edge 301. The first circuit board 200 is provided with main electronic elements for operation of the electronic device, such as a central processor 202. The second circuit board 300 is provided with an I/O (input/out) connector 302 with an insert port exposed from a side surface 101 of the electronic device casing 100. Of course, the first circuit board 200 may also be provided with other I/O connector (not illustrated in the Figures). Such as laptop computers, mobile phones and the like are applicable electronic devices. In the embodiment, the receptacle connector 400 is provided to the first circuit board 200 provided with the central processor 202 as a mother-circuit board, the plug connector 500 is provided to the second circuit board 300 provided with the I/O connector 302 as a daughter-circuit board. However it can be understood that, the receptacle connector 400 may also be provided to the second circuit board 300 provided with the I/O connector 302 as the daughter-circuit board, and the plug connector 500 is provided to the first circuit board 200 provided with the central processor 202 as the mother-circuit board. That is, the receptacle connector 400 may be provided to one of the mother-circuit board and daughter-circuit board, while the plug connector 500 is provided to the other one.

Figure 3:
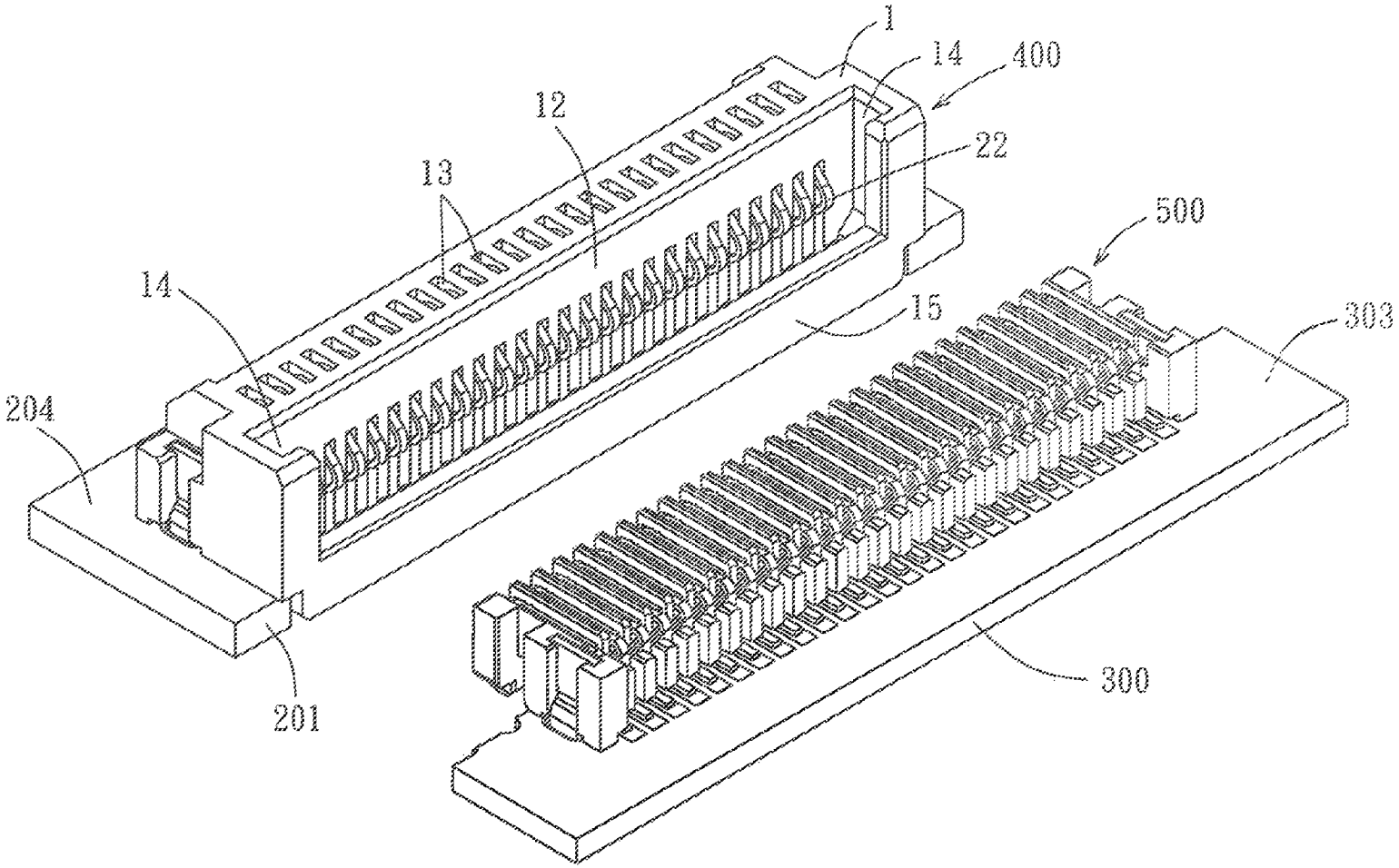
FIG. 3 and FIG. 4 are views viewed from different angle and illustrating a corresponding relationship of the receptacle connector and the plug connector of the embodiment.
Figure 4:
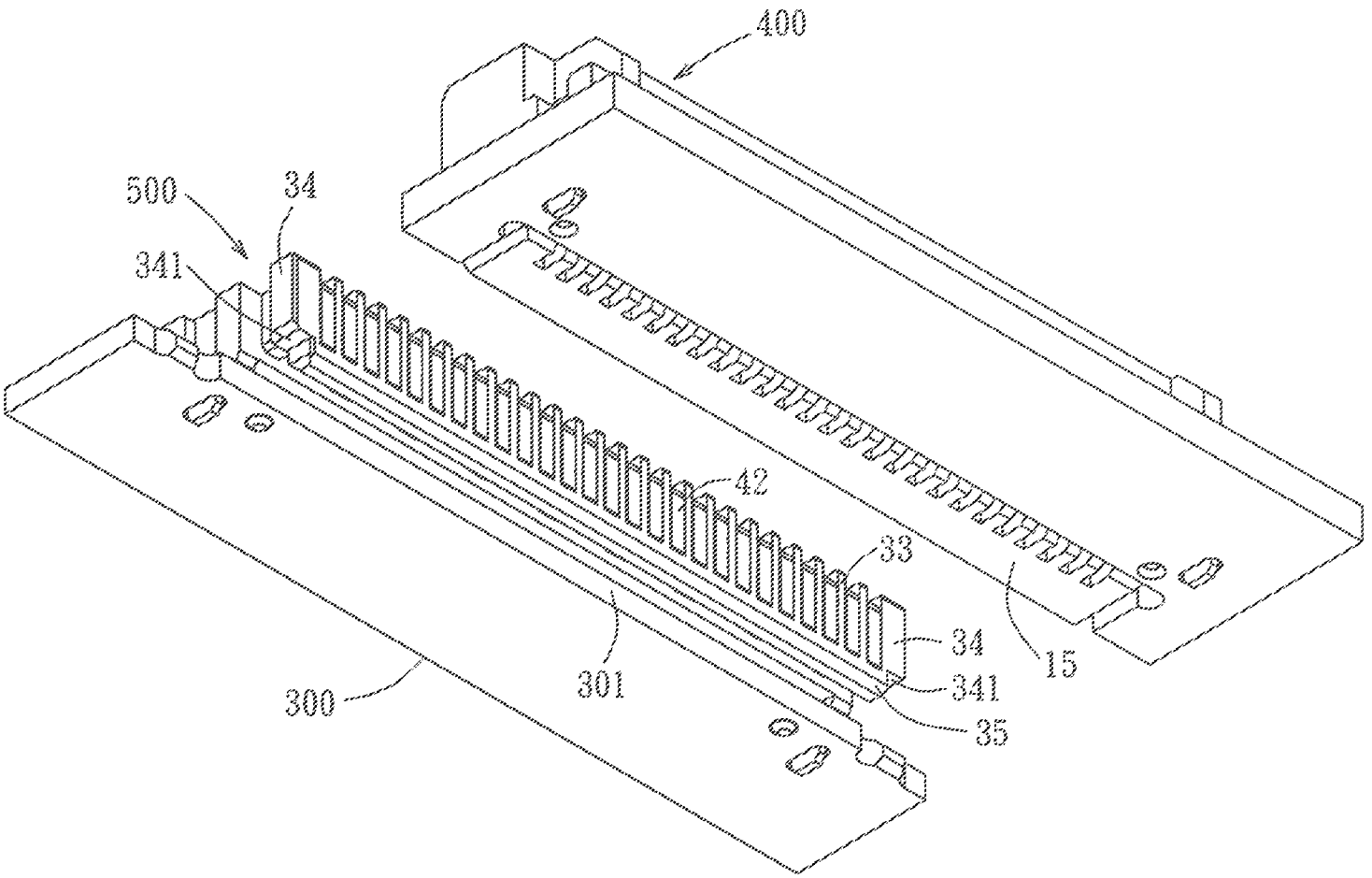
Figure 5:
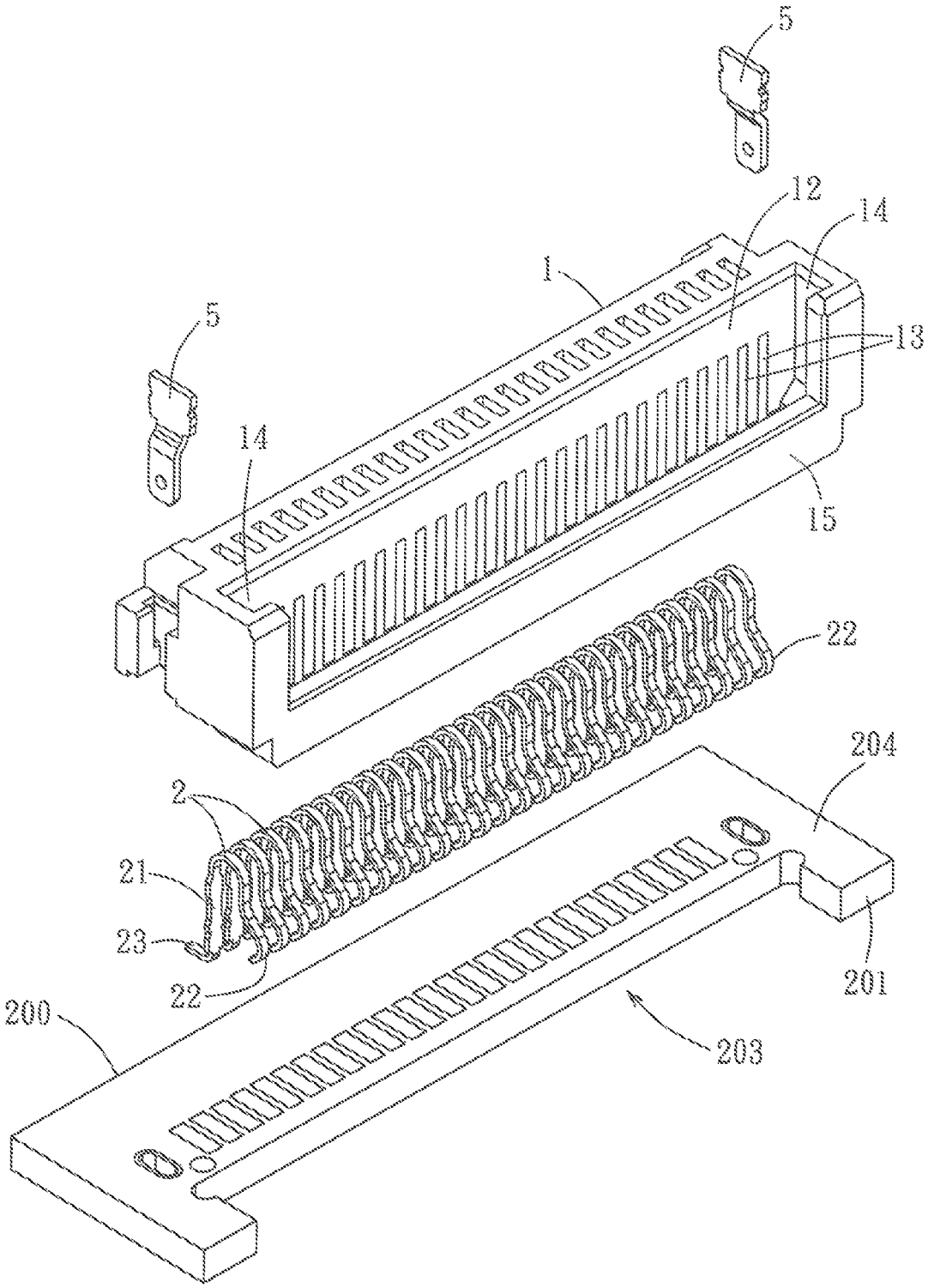
FIG. 5 is an exploded perspective view illustrating the receptacle connector of the embodiment.
Figure 6:
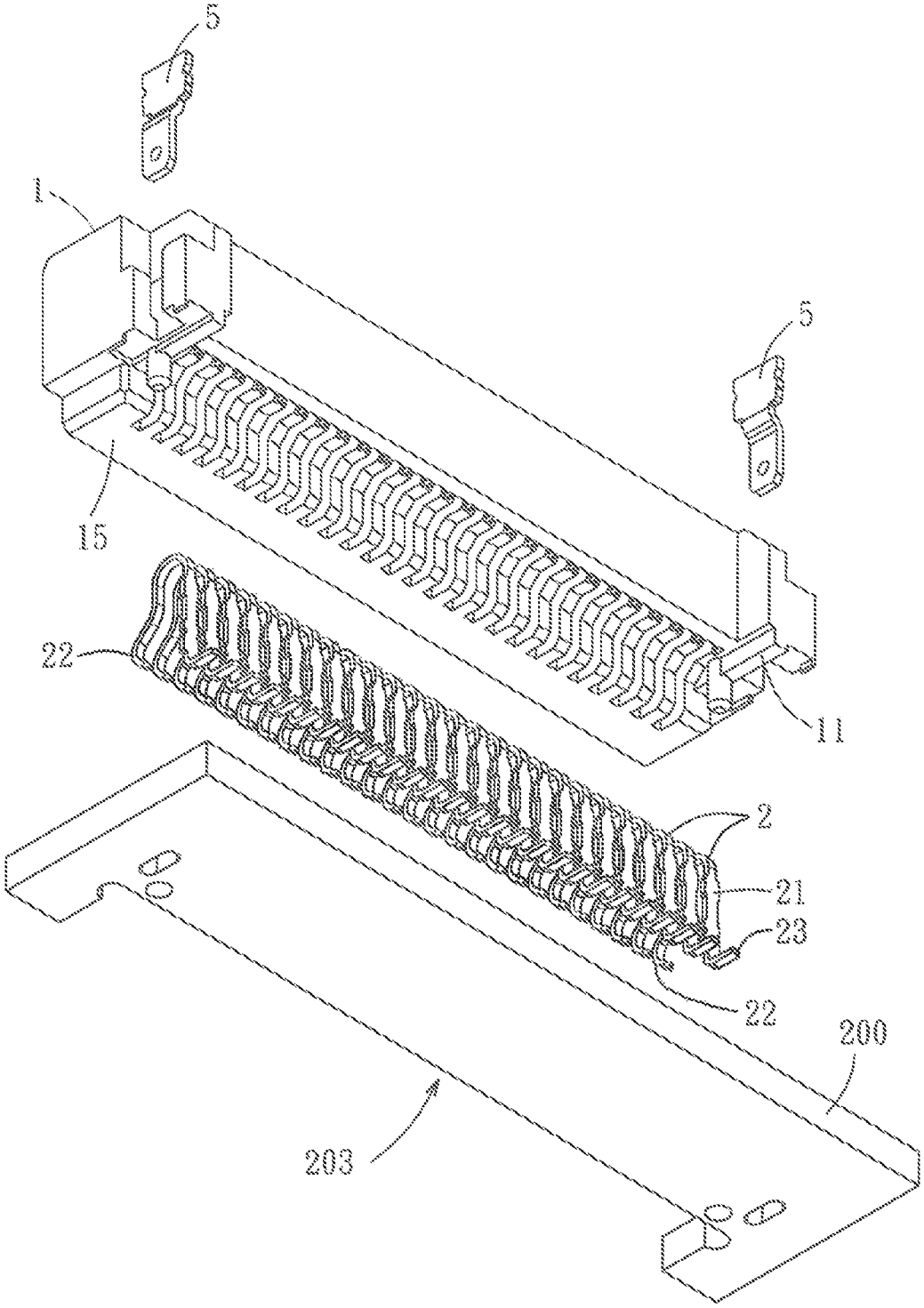
FIG. 6 is a view of FIG. 5 viewed from another angle.
Figure 7:
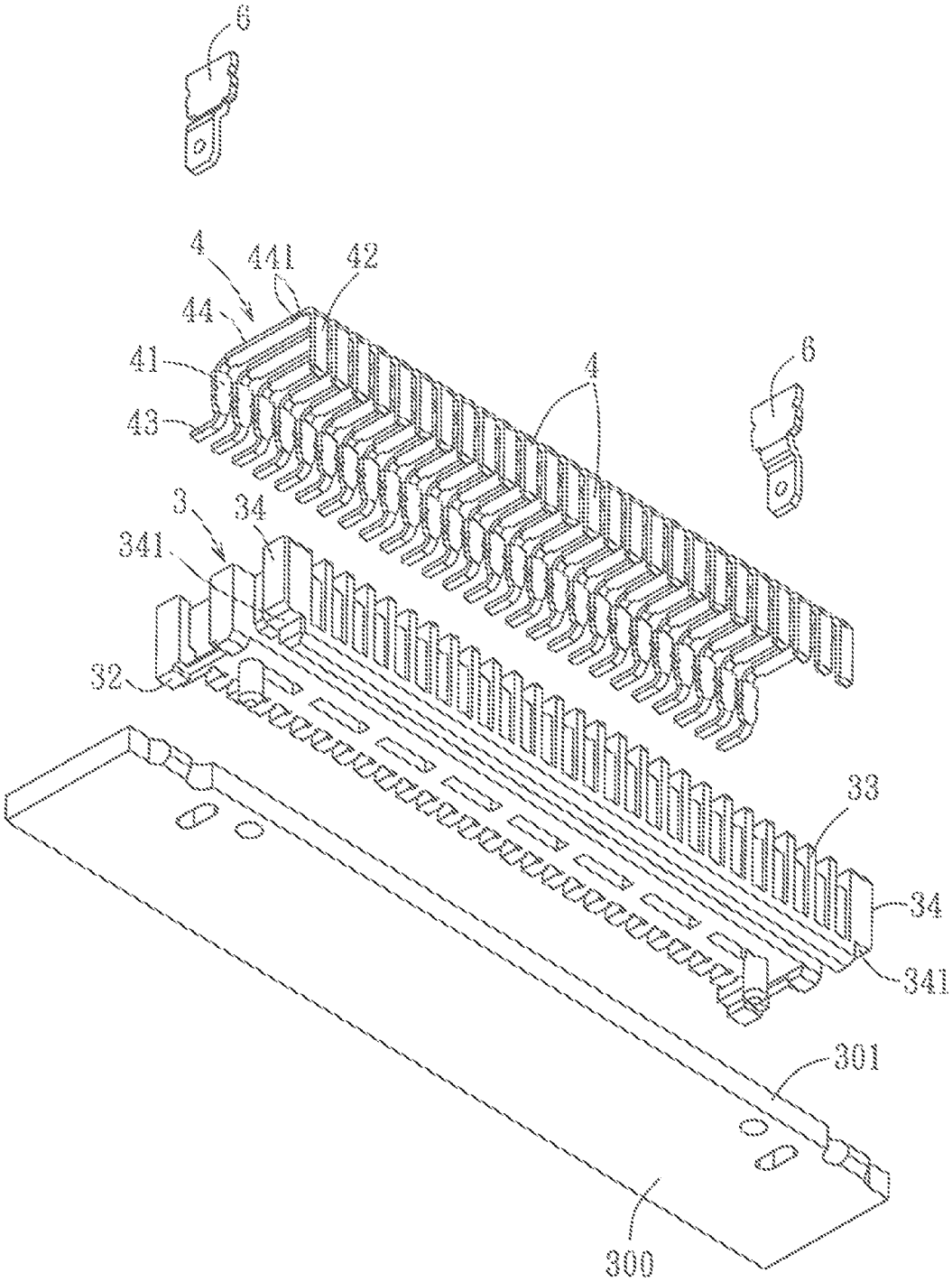
FIG. 7 is an exploded perspective view illustrating the plug connector of the embodiment.
Figure 8:
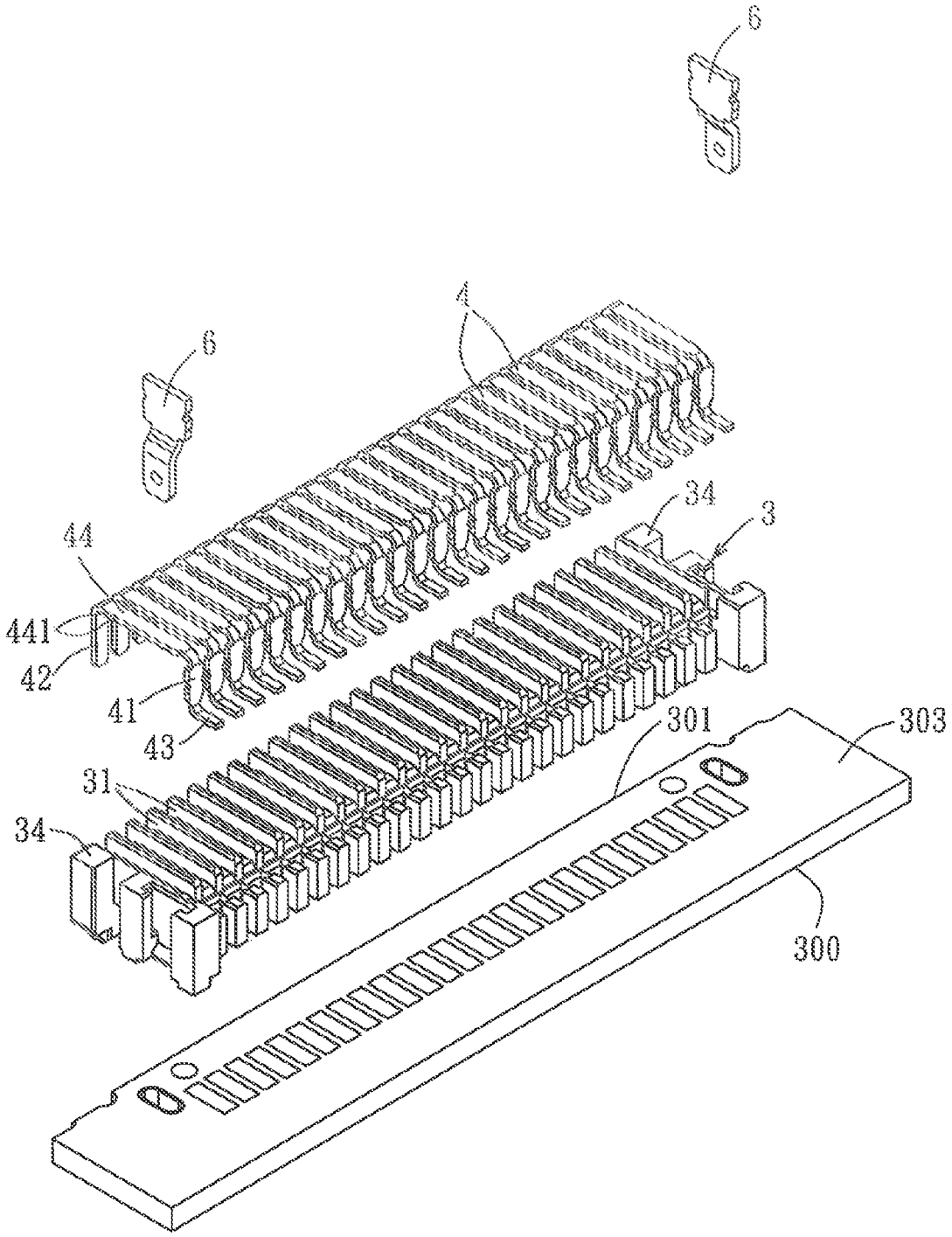
FIG. 8 is a view of FIG. 7 viewed from another angle.
Figure 9:
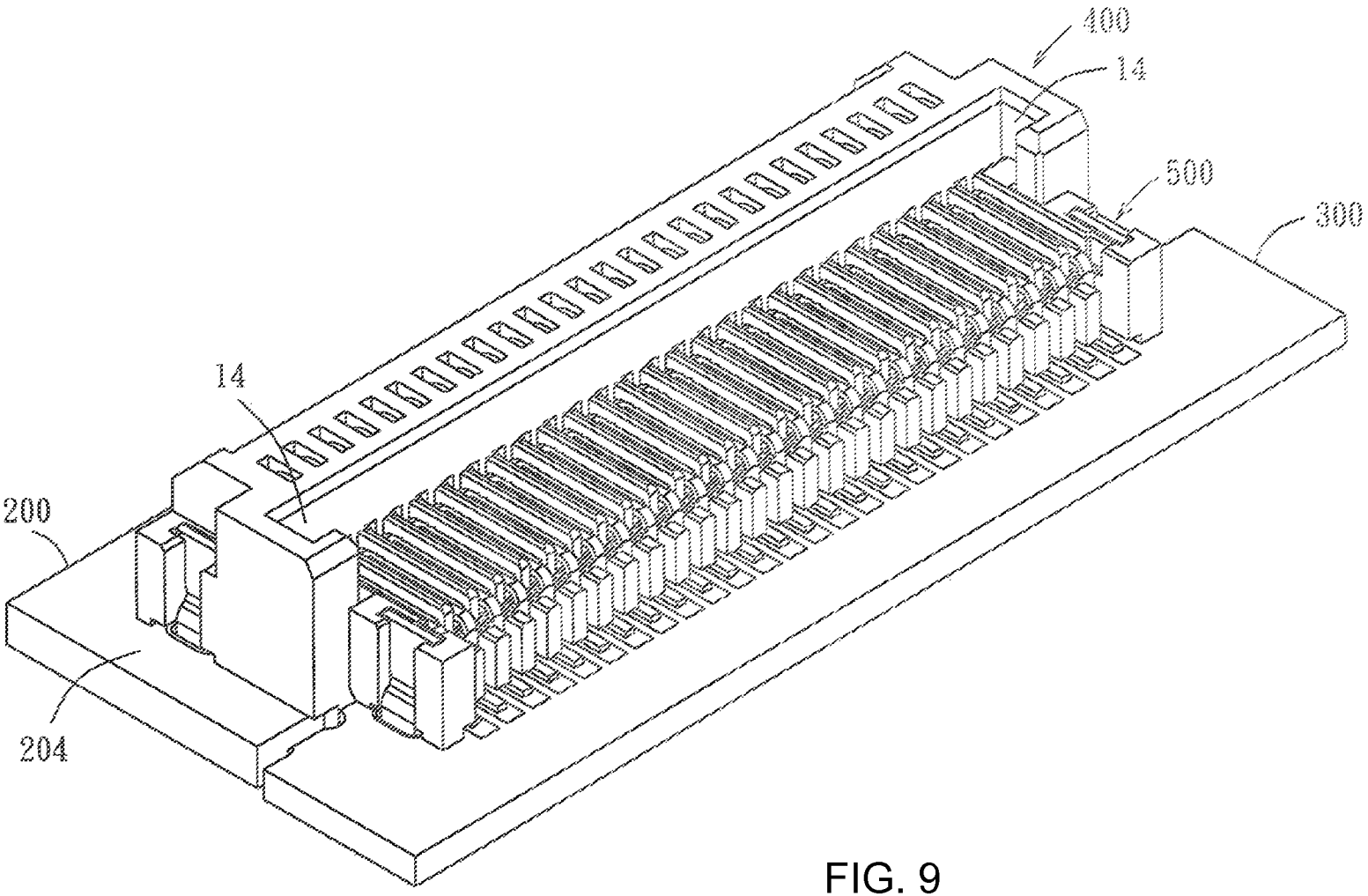
FIG. 9 is a perspective view illustrating a mating state of the receptacle connector and the plug connector of the embodiment.
Figure 11:
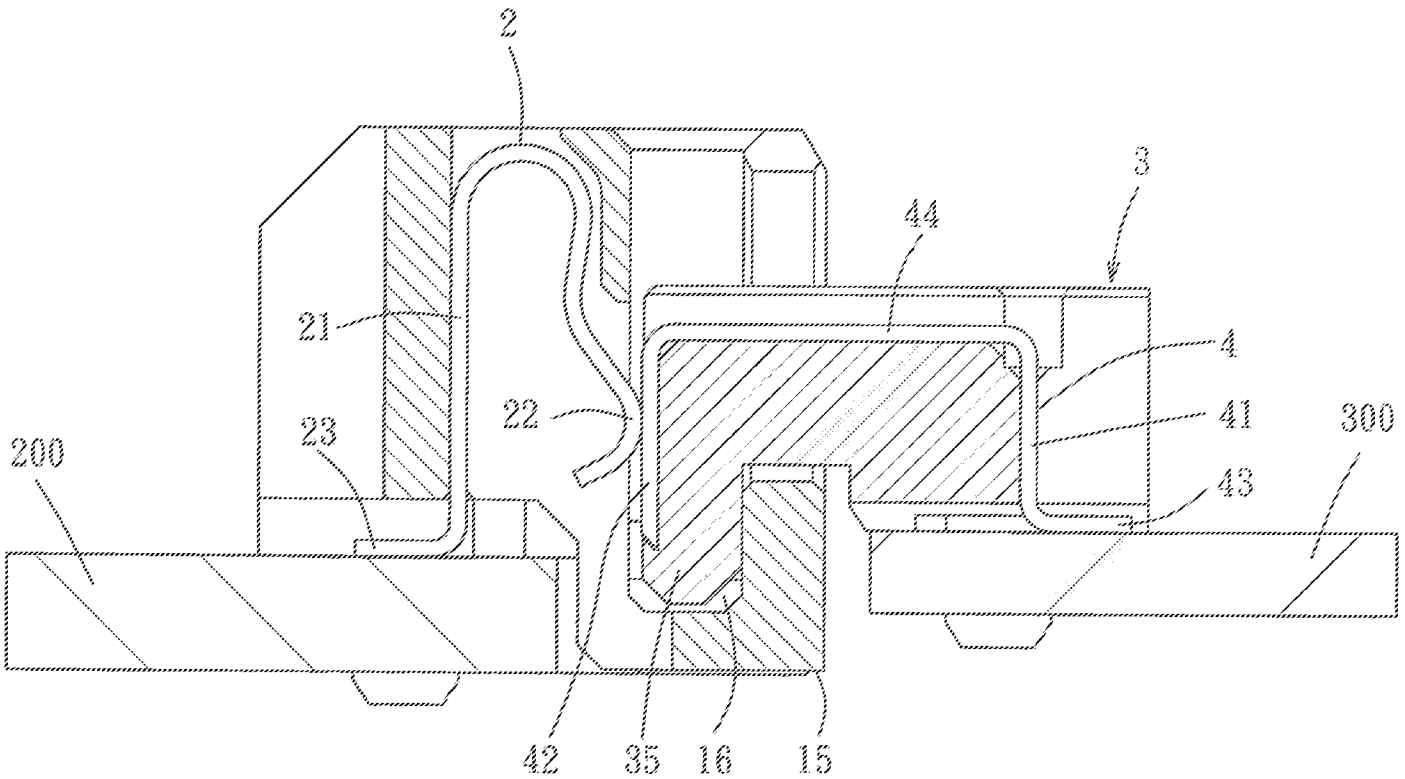
FIG. 11 is a cross-sectional view taken along a line XI-XI of FIG. 10.

Referring to FIG. 3, FIG. 5 and FIG. 6, the first circuit board 200 further has a notch 203 recessing inwardly from the first side edge 201. The receptacle connector 400 comprises a housing 1, which can be formed of an insulative material, and a plurality of first terminals 2. The housing 1 has a first mounting surface 11 abutting against a board surface 204 of the first circuit board 200, a first mating surface 12, a plurality of terminal grooves 13 arranged at intervals, a pair of sliding contact grooves 14 respectively adjacent to both sides of the first mating surface 12, and a bottom projection 15 positioned at bottom sides of the first mating surface 12 and the sliding contact grooves 14. The first mating surface 12 and the sliding contact grooves 14 are substantially perpendicular to a plane where the first mounting surface 11 is present, that is, the first mating surface 12 and the sliding contact grooves 14 are also substantially perpendicular to a board surface 204 of the first circuit board 200. The bottom projection 15 is received in the notch 203 and together defines a receiving groove 16 (referring to FIG. 11). The first terminals 2 are received in the terminal grooves 13 respectively and each have a first fixed portion 21 fixedly provided to the housing 1, a first contact portion 22 exposed from the first mating surface 12, and a first tail portion 23 exposed from the first mounting surface 11 and electrically connected to the first circuit board 200. In the embodiment, the first fixed portion 21 is fixed by interference with the housing 1. The first contact portion 22 has resilience. The first tail portion 23 is fixed to the first circuit board 200 by soldering. The housing 1 is fixed the first circuit board 200 by soldering two soldering pieces 5.

Figure 12:
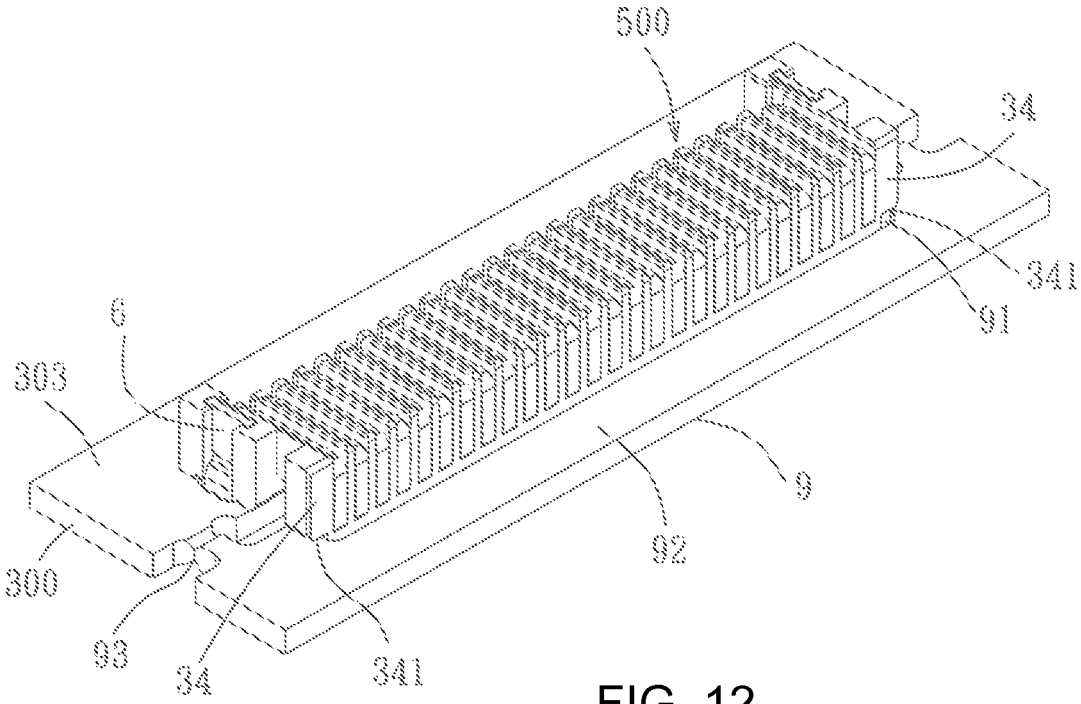
FIG. 12 is a perspective view illustrating a state of auxiliary soldering operation with a support plate before the plug connector of the embodiment is fixed by soldering.
Figure 13:
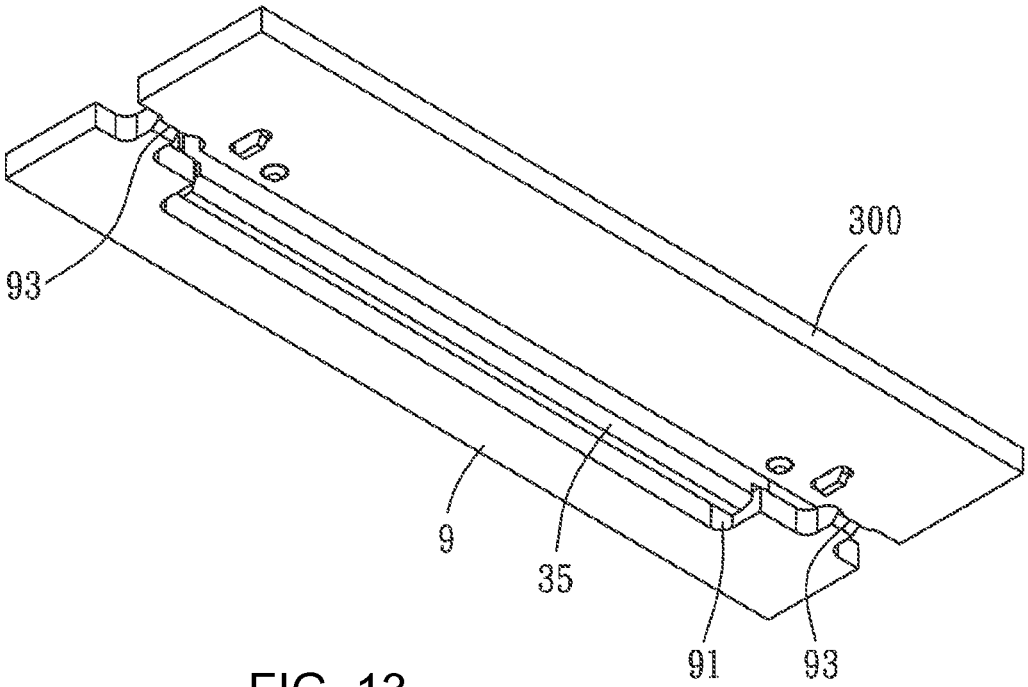
FIG. 13 is a view of FIG. 12 viewed from another angle.

Referring to FIG. 4, and FIGS. 7-9, the plug connector 500 comprises a body 3, which can be formed of an insulative material, and a plurality of second terminals 4. The body 3 has a plurality of terminal grooves 31 arranged at intervals, a second mounting surface 32 abutting against a board surface 303 of the second circuit board 300, a second mating surface 33 substantially perpendicular to a plane where the second mounting surface 32 is present and corresponding to the first mating surface 12, and a pair of side flanges 34 respectively adjacent to both sides of the second mating surface 33 and respectively engaged with and received in the sliding contact grooves 14. The side flanges 34 each have a bottom surface 341 coplanar with the second mounting surface 32. The body 3 further has a bottom flange 35 connected to bottom sides of the second mating surface 33 and the side flanges 34 and protruding from the bottom surface 341 of the side flanges 34, and the bottom flange 35 is engaged with and received in the receiving groove 16 (referring to FIG. 11). The second terminals 4 are received in the terminal grooves 31 respectively and each have a second fixed portion 41 fixedly provided to the body 3, a second contact portion 42 exposed from the second mating surface 33 and taking in form of a flat plate shape, a second tail portion 43 exposed from the second mounting surface 32 and electrically connected to the second circuit board 300, and an extension portion 44 connected to the second fixed portion 41 and the second contact portion 42. The extension portion 44 extends substantially parallel to the plane where the second mounting surface 32 is present and has a plurality of protrusions 441 respectively protruding from both sides close to the second contact portion 42. The second fixed portion 41 and the second contact portion 42 are substantially perpendicular to the extension portion 44, that is, the second fixed portion 41, the extension portion 44 and the second contact portion 42 together form an inverted U-shaped configuration. In the embodiment, the second fixed portion 41 is fixed by interference with the body 3, and the extension portion 44 is also fixed by interference with the body 3 via the protrusions 441. The second tail portion 43 is fixed to the second circuit board 300 by soldering. The body 3 is also fixed to the second circuit board 300 by soldering two soldering pieces 6. In combination with referring to FIG. 12 and FIG. 13, in order to facilitate soldering operations, the second circuit board 300 is firstly connected to a support plate 9. The support plate 9 has a notch 91 receiving the bottom flange 35, so as to allow the bottom surfaces 341 of the side flanges 34 to respectively abut against plate surfaces 92 at both sides of the notch 91, thereby supporting the part of the plug connector 500 protruding from the second circuit board 300. So it can be ensured that before the soldering is completed, the second mounting surface 32 and the second tail portion 43 all can abut against the board surface 303 of the second circuit board 300, so as to avoid poor soldering. After the soldering is completed and the plug connector 500 is fixed to the second circuit board 300, as the support plate 9 is connected to the second circuit board 300 only by two connecting points 93, the support plate 9 is easily broken at the connecting points 93 so as to remove the support plate 9.

Figure 10:
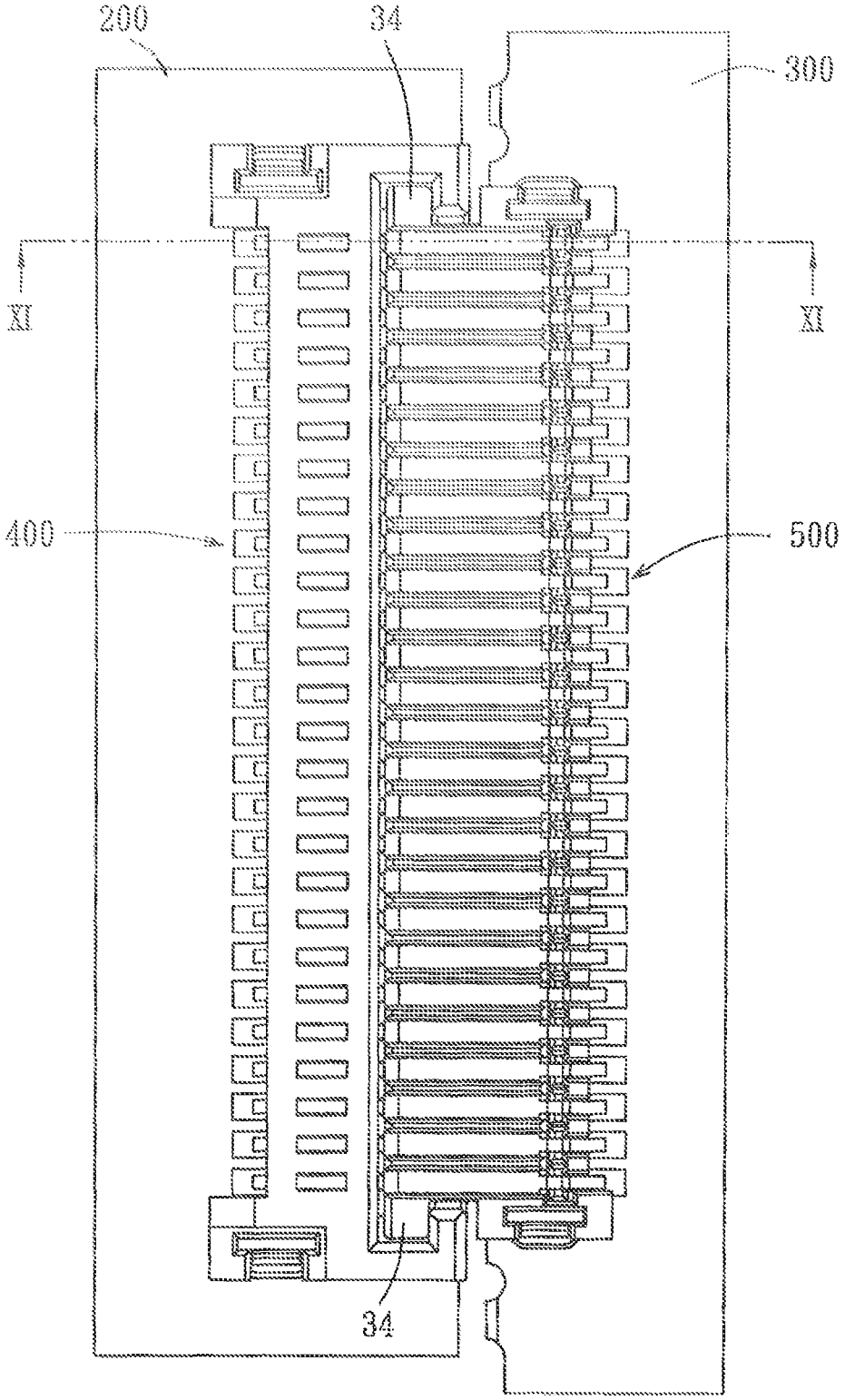
FIG. 10 is a top view illustrating a mating state of the receptacle connector and the plug connector of the embodiment.

Referring to FIGS. 9-11 again, when the plug connector 500 and the receptacle connector 400 are mated, the side flanges 34 positioned at both sides are respectively aligned with the sliding contact grooves 14, and the side flanges 34 respectively slide into the sliding contact grooves 14 of the receptacle connector 400 vertically or in a direction perpendicular to the board surface 203 of the first circuit board 200, and the second mating surface 33 moves from downward to the first mating surface 12, until the bottom flange 35 of the plug connector 500 is received in the receiving groove 16 of the receptacle connector 400. One that happens the second contact portions 42 of the second terminals 4 are respectively in contact with the first contact portions 22 of the first terminals 2 and form an electrical connection. During the process the second contact portion 42 slides along with the second mating surface 33 and contacts the corresponding first contact portion 22. As the protrusion 441 of the extension portion 44 of the second terminal 4 is positioned close to the second contact portion 42, fixation of the second terminal 4 is strengthened so as to avoid movement of the second contact portion 42 which is subjected to a force from the first contact portion 22.

As the plug connector 500 is mated with the receptacle connector 400 in a direction perpendicular to the board surface 203 of the first circuit board 200, the electronic device casing 100 can be smaller while still providing enough space to allow the first circuit board 200 to installed first and the second circuit board 300 to be installed second, thus the depicted design facilitates assembly operations. In the embodiment, sizes of the first circuit board 200 and the second circuit board 300 can be designed based on minimum sizes of the same type of electronic devices but when the size of the electronic device is increased, namely the size of the electronic device casing 100 is increased, with the second circuit board 300 can be replaced with a version having a larger size, so as to ensure the I/O connector 302 of the second circuit board 300 is still exposed on the side surface 101 of the electronic device casing 100. In other words, replacement with the second circuit board 300 having the larger size is to increase a distance between the plug connector 500 and the I/O connector 302 so as to adapt to the increased size of the electronic device casing 100. In this way, it is possible to use the first circuit board 200 having a fixed size matched with the second circuit board 300 having different sizes and use the receptacle connector 400 and the plug connector 500 to electrically connect the first circuit board 200 and the second circuit board 300. Thus the depicted embodiments are suitable for applications where the electronic device casing 100 is expected to have difference sizes. Furthermore, the first circuit board 200 is directly electrically connected to the second circuit board 300 by the receptacle connector 400 and the plug connector 500, thereby reducing impedance and providing good electrical characteristics. The design can also reduce cost due to utilization of the same two connectors for different sized applications.

The above described is only the specific embodiment, which can not limit the scope of the implementation of the present disclosure, namely simple equivalent variations and modifications made according to the scope of the claims and content of the present disclosure are still fallen within the scope of the present disclosure.

What is claimed is:

1. An electrical connection device used to be provided in an electronic device casing, the electrical connection device comprising:

a first circuit board having a first side edge;

a second circuit board substantially coplanar with the first circuit board and having a second side edge opposite to the first side edge;

a receptacle connector provided to the first circuit board and closely adjacent to the first side edge, comprising an housing having a first mounting surface abutting against a board surface of the first circuit board, a first mating surface, and a pair of sliding contact grooves respectively adjacent to both sides of the first mating surface, and the first mating surface and the sliding contact grooves being substantially perpendicular to a plane where the first mounting surface is present; and a plurality of first terminals each having a first fixed portion fixedly provided to the housing, a first contact portion exposed from the first mating surface, and a first tail portion exposed from the first mounting surface and electrically connected to the first circuit board; and a plug connector provided to the second circuit board and partially protruding from the second side edge, comprising an body, having a second mounting surface abutting against a board surface of the second circuit board, a second mating surface substantially perpendicular to a plane where the second mounting surface is present and corresponding to the first mating surface, and a pair of side flanges respectively adjacent to both sides of the second mating surface and respectively engaged with and received in the sliding contact grooves; and a plurality of second terminals each having a second fixed portion fixedly provided to the body, a second contact portion exposed from the second mating surface, and a second tail portion exposed from the second mounting surface and electrically connected to the second circuit board, the second contact portions of the second terminals respectively contacting the first contact portions of the first terminals so as to form an electrical connection.

2. The electrical connection device according to claim 1, wherein one of the first circuit board and the second circuit board is provided with a plurality of I/O connectors with insert ports thereof exposed from a side surface of the electronic device casing.

3. The electrical connection device according to claim 2, wherein the other one of the first circuit board and the second circuit board is provided with a central processor.

4. The electrical connection device according to claim 1, wherein the second terminals each further have an extension portion connected to the second fixed portion and the second contact portion, the extension portion extends substantially parallel to the plane where the second mounting surface is present and has a plurality of protrusions respectively protruding from both sides close to the second contact portion, the second fixed portion and the second contact portion are substantially perpendicular to the extension portion.

5. The electrical connection device according to claim 1, wherein the first contact portions of the first terminals have resilience, the second contact portions of the second terminals are in form of flat plate shape.

6. The electrical connection device according to claim 1, wherein the side flanges each have a bottom surface coplanar with the second mounting surface.

7. The electrical connection device according to claim 6, wherein the first circuit board further has a notch recessing inwardly from the first side edge; the housing further has a bottom projection positioned at bottom sides of the first mating surface and the sliding contact grooves, the bottom projection is received in the notch and together defines a receiving groove; the body further has a bottom flange connected to bottom sides of the second mating surface and the side flanges and protruding from the bottom surfaces of the side flanges, and the bottom flange is engaged with and received in the receiving groove.

* * * * *